US006406566B1

(12) United States Patent
Ishida et al.

(10) Patent No.: US 6,406,566 B1
(45) Date of Patent: Jun. 18, 2002

(54) COPPER-BASED ALLOY HAVING SHAPE MEMORY PROPERTIES AND SUPERELASTICITY, MEMBERS MADE THEREOF AND METHOD FOR PRODUCING SAME

(75) Inventors: Kiyohito Ishida, 5-20 Kamisugi 3-chome, Aoba-ku, Sendai-shi, Miyagi-ken; Ryosuke Kainuma; Yuji Sutoh, both of Miyagi-ken, all of (JP)

(73) Assignees: Kiyohito Ishida, Miyagi-ken; Yoshikazu Ishii, Tokyo, both of (JP)

( * ) Notice: Subject to any disclaimer, the term of this patent is extended or adjusted under 35 U.S.C. 154(b) by 0 days.

(21) Appl. No.: 09/613,563

(22) Filed: Jul. 10, 2000

(30) Foreign Application Priority Data

Jul. 8, 1999 (JP) ..... 11-194584

(51) Int. Cl.[7] ..... C22C 9/05

(52) U.S. Cl. ..... 148/402; 148/411; 420/489; 420/493

(58) Field of Search ..... 148/402, 411; 420/489, 493

(56) References Cited

U.S. PATENT DOCUMENTS 4,518,444 A * 5/1985 Albrecht et al. ..... 148/402

4,750,953 A * 6/1988 Tabei ..... 148/402

FOREIGN PATENT DOCUMENTS

JP 07062472 3/1995

OTHER PUBLICATIONS

Otsuka et al., "Shape Memory Materials", *Cambridge University Press*, pp. 143–144, no date.

* cited by examiner

*Primary Examiner*—George Wyszomierski
(74) *Attorney, Agent, or Firm*—Browdy and Neimark

(57) ABSTRACT

The present invention provides a copper-based alloy having high shape memory properties and superelasticity while maintaining an excellent workability, members such as a wire, plate, pipe, etc. made of the copper-based alloy, and methods for producing them. The copper-based alloy has a recrystallization structure substantially composed of β-single phase, and can be produced by a method comprising the steps of: forming an alloy by cold-working with a particular maximum cold-working ratio; and subjecting the cold-worked alloy to at least one solution treatment for improving a crystal orientation of the β-single phase, a quenching and an aging treatment. The maximum cold-working ratio is set so that the crystal orientation density of the β-single phase measured by an electron back scattering pattern method is 2.0 or more in a cold-working direction.

17 Claims, 11 Drawing Sheets

Crystal Orientation Density in Rolling Direction

Crystal Orientation Density in Rolling Direction

Crystal Orientation Density in Rolling Direction

Crystal Orientation Density in Rolling Direction

COPPER-BASED ALLOY HAVING SHAPE MEMORY PROPERTIES AND SUPERELASTICITY, MEMBERS MADE THEREOF AND METHOD FOR PRODUCING SAME

FIELD OF THE INVENTION

The present invention relates to a copper-based alloy excellent in shape memory properties and superelasticity, members such as a wire, plate, foil, pipe, etc. made of the copper-based alloy, and methods for producing the copper-based alloy or the members.

DESCRIPTION OF THE PRIOR ART

It has been well known that shape memory alloys such as Ti—Ni alloys, copper-based alloys, etc. exhibit a remarkable shape memory properties and superelasticity by the inverse transformation of martensitic transformation. The Ti—Ni alloys are excellent in the shape memory properties and superelasticity at the vicinity of a daily life surrounding temperature to have been widely used in various applications such as dampers for microwave ovens, wind-controllers of air conditioners, steam pressure-controlling valves of rice cookers, air-vents for architectures, antennas of cellular phones, glass frames, brassiere flames, etc. Though the Ti—Ni alloys are superior in many aspects such as repeatability and corrosion resistance to the copper-based alloys, the Ti—Ni alloys are more than 10 times expensive as the copper-based alloys. Thus, it is desired to develop a less expensive, superelastic, shape memory alloy.

Under these circumstances, such studies as to put the copper-based shape memory alloys with cost advantages into practical use have been carried out. However, most of the conventional copper-based alloys are poor in cold-workability, cannot be cold-worked at a cold-working ratio of or more (Shape Memory Materials, Cambridge press, 1998, p.143), thereby being far from practicable. Therefore, researches for making the crystal grains composing the alloys fine to improve its cold-workability and mechanical properties have been in progress. The inventors previously proposed Cu—Al—Mn shape memory alloys excellent in the cold-workability, having a β-single phase structure (Japanese Patent Laid-Open No. 7-62472).

The above-mentioned Cu—Al—Mn shape memory alloys have excellent shape memory properties and superelasticity. However, with respect to the alloy, a maximum strain providing a shape recovery ratio of 90% or more is approximately 2 to 3% as well as the conventional copper-based alloys, and its superelasticity is often insufficient. The reason for the insufficient superelasticity seems that the Cu—Al—Mn alloys are produced by conventional cold-working at the working-ratio of less than 30% without improving a crystal orientation of the alloy, thereby failing to obtain preferable crystal orientation.

OBJECT OF THE INVENTION

Accordingly, an object of the present invention is to provide a copper-based alloy having high shape memory properties and superelasticity while maintaining an excellent workability, members such as a wire, plate, foil, pipe, etc. made of the copper-based alloy, and methods for producing the copper-based alloy or members.

SUMMARY OF THE INVENTION

As a result of intense research in view of the above object, the inventors have found that the shape memory properties and superelasticity of a copper-based alloy can be extremely improved by a method for making crystal grains fine different from conventional methods. Thus, the inventors have found that the shape memory properties and superelasticity of the copper-based alloy is remarkably improved by aligning crystal orientation of β-single phase composing a microstructure of the copper-based alloy, and that a maximum cold-working ratio in cold-working and conditions of a solution treatment affect to the crystal orientation of β-single phase, and further that the larger an average grain diameter in the β-single phase, the better the shape memory properties are. Furthermore, the inventors have found that in the case of producing members such as a wire, plate, foil, pipe, etc. from the copper-based alloy, the shape memory properties and superelasticity of the members can be improved by setting the conditions of the solution treatment such that the average grain diameter in the β-single phase is equal to or more than the radius or thickness of the members. The present invention has been accomplished by these findings.

Thus, a copper-based alloy according to the present invention, which has shape memory properties and superelasticity, has a recrystallization structure substantially composed of β-single phase having crystal orientation aligned in a cold-working direction, and wherein the crystal orientation density measured by an electron back scattering pattern method is 2.0 or more in the cold-working direction.

The copper-based alloy is formed by repeating a cycle of annealing and cold-working a plurality of times. The crystal orientation of the β-single phase is preferably <110> or <100> orientation. The copper-based alloy is preferably produced by a method comprising a plurality of solution treatments to improve the crystal orientation density in the cold-working direction.

The copper-based alloy preferably has a composition comprising 3 to 10 weight % of Al, 5 to 20 weight % of Mn, the balance being substantially Cu and inevitable impurities. The composition may further comprise at least one metal selected from the group consisting of Ni, Co, Fe, Ti, V, Cr, Si, Nb, Mo, W, Sn, Sb, Mg, P, Be, Zr, Zn, B, C, Ag and misch metals in a total amount of 0.001 to 10 weight % based on the copper-based alloy of 100 weight %.

A method for producing the copper-based alloy according to the present invention comprises the steps of: repeating a cycle of annealing and cold-working to an alloy a plurality of times, a maximum cold-working ratio being 30% or more in the cold-working; and subjecting the cold-worked alloy to a solution treatment at least once, a quenching and an aging treatment.

After the solution treatment, the alloy is preferably cooled down to a temperature range, at which microstructure thereof is transformed into β+α dual phase, and subjected to another solution treatment. In particular, it is preferable that a cycle of the solution treatment and cooling is carried out twice or more, and that the final cooling is rapid cooling. It is preferred that the annealing is carried out to transform a microstructure of the alloy into such that comprising α-phase of 20 volume % or more before each cold-working. The maximum cold-working ratio is generally 30% or more, particularly preferably 50% or more in the cold-working.

A wire according to the present invention is made of the copper-based alloy having an average grain diameter equal to or more than the radius of the wire. The average grain diameter is preferably twice or more to the wire diameter. Further, a region of the wire, in which the copper-based alloy has a grain diameter equal to or more than the radius of the wire, preferably has a length of 30% or more based on the entire length of the wire. Specifically, in the case of the wire having the radius of 0.25 mm, it is preferably that 30% or more of the entire crystal grains has a diameter of 0.3 mm or more. The wire of the present invention may be used as guide wires for catheters, twisted wires, etc. The wire can be produced by a method comprising the steps of: repeating a cycle of annealing and cold-working to an alloy a plurality of times to form the alloy in a wire shape having a predetermined diameter; and subjecting the cold-worked alloy to a solution treatment at least once, a quenching and an aging treatment.

A plate or foil according to the present invention is made of the copper-based alloy having an average grain diameter equal to or more than a thickness of the plate or foil. The average grain diameter is preferably twice or more to the thickness of the plate or foil. Further, a region of the plate or foil, in which the copper-based alloy has a grain diameter equal to or more than the thickness of the plate or foil, preferably has an area of 30% or more based on the entire area of the plate or foil. Specifically, in the case of the plate or foil having the thickness of 0.5 mm, it is preferably that 50% or more of the entire crystal grains has a diameter of 0.5 mm or more. The plate or foil of the present invention may be used for connector members, clips for writing implements, etc. The plate and foil can be produced by a method comprising the steps of: repeating a cycle of annealing and cold-working to an alloy a plurality of times to form the alloy in a plate or foil shape having a predetermined thickness; and subjecting the cold-worked alloy to a solution treatment at least once, a quenching and an aging treatment.

A pipe according to the present invention is made of the copper-based alloy having an average grain diameter equal to or more than a thickness of the pipe. A region of the pipe, in which the copper-based alloy has a grain diameter equal to or more than the thickness of the pipe, preferably has an area of 30% or more based on the entire area of the pipe. The pipe can be produced by a method comprising the steps of: forming an alloy in a pipe shape by hot extrusion, etc.; repeating a cycle of annealing and cold-working to the formed alloy a plurality of times; and subjecting the cold-worked alloy to a solution treatment at least once, a quenching and an aging treatment.

BRIEF DESCRIPTION OF THE DRAWINGS

FIG. 1(*b*) is a schematic view showing a microstructure of a wire obtained by repeating a cycle of annealing and cold-working to the wire shown in FIG. 1(*a*) a plurality of times, and subjecting the cold-worked wire to a solution treatment;

FIG. 1(*c*) is a schematic view showing a microstructure of a wire obtained by subjecting the wire shown in FIG. 1(*b*) to a plurality of solution treatments;

FIG. 2(*b*) is a schematic view showing a microstructure of a plate obtained by repeating a cycle of annealing and cold-rolling to the plate shown in FIG. 2(*a*) a plurality of times, and subjecting the cold-rolled plate to a solution treatment;

FIG. 3(*b*) is a schematic view showing the other example of processes with a maximum cold-working ratio of 60% from forming to a solution treatment according to a method for producing a copper-based alloy of the present invention;

FIG. 3(*c*) is a schematic view showing the other example of processes with a maximum cold-working ratio of 75% from forming to a solution treatment according to a method for producing a copper-based alloy of the present invention;

FIG. 9(*b*) is a graph showing a relation corresponding to various maximum cold-working ratios between an average grain diameter and the <110> orientation density in a rolling direction according to copper-based alloy plates of Examples 1 to 3;

FIG. 12(*b*) is a graph showing a relation between a ratio of average grain diameter in β-phase/wire diameter in a range of 0 to 0.8 and a shape recovery ratio according to a copper-based alloy wire of Example 12;

FIG. 13(*b*) is a graph showing a relation between a ratio of average grain diameter in β-phase/plate thickness in a range of 0 to 5 and shape recovery ratio according to copper-based alloy plates of Example 13 each having different composition.

DETAILED DESCRIPTION OF THE PREFERRED EMBODIMENTS

[1] Copper-based Alloy (1) Composition

Figure 1A:
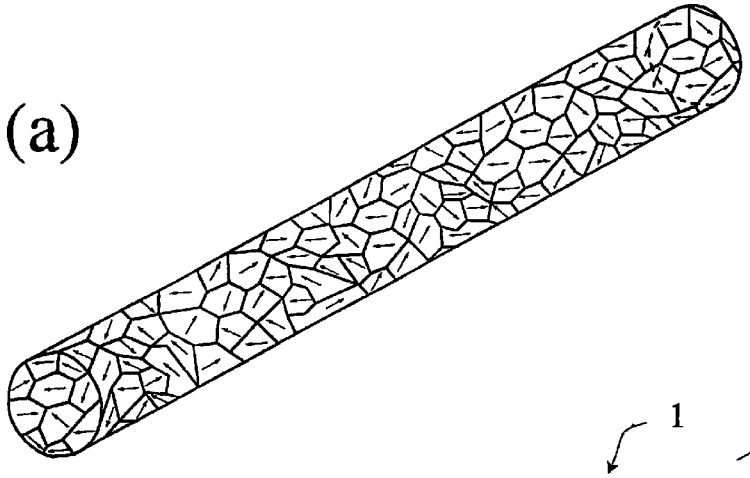
FIG. 1(*a*) is a schematic view showing a microstructure of a wire obtained by hot-drawing a copper-based alloy.

The copper-based alloy of the present invention having shape memory properties and superelasticity has a β-phase structure [body-centered cubic (bcc) structure] at a high temperature, wherein the β-phase structure is changed to a dual-phase structure of the β-phase and α-phase [face-centered cubic (fcc) structure] at a low temperature, and contains at least Al and Mn. The copper-based alloy of the present invention preferably has a composition containing 3 to 10 weight % of Al, 5 to 20 weight % of Mn, and the balance being substantially Cu and inevitable impurities.

When the Al content is less than 3 weight %, the microstructure of the alloy cannot be composed of β-single phase. On the other hand, when it exceeds 10 weight %, the resultant alloy becomes extremely brittle. The preferred Al content is 6 to 10 weight %, though it may be changed depending on the amount of Mn.

The inclusion of Mn makes the range of the β-phase shift toward a low Al region, thereby remarkably improving the cold-workability of the copper-based alloy. When the Mn content is less than 5 weight %, sufficient cold-workability cannot be obtained, failing to form the region of the β-single phase. On the other hand, when the Mn content exceeds 20 weight %, sufficient shape memory properties cannot be obtained. The preferred content of Mn is 8 to 12 weight %.

In addition to the above basic components, the copper-based alloy of the present invention may further contain at least one metal selected from the group consisting of Ni, Co, Fe, Ti, V, Cr, Si, Nb, Mo, W, Sn, Sb, Mg, P, Be, Zr, Zn, B, C, Ag and misch metals. Among them, Ni and/or Co is particularly preferable. These elements act to improve the strength of the copper-based alloy while maintaining the cold-workability thereof. The total content of these additional elements is preferably 0.001 to 10 weight %, particularly 0.001 to 5 weight %. When the total content of these elements exceeds 10 weight %, the martensitic transformation temperature of the alloy lowers, making the β-single phase structure unstable.

Ni, Co, Fe, Sn and Sb are elements effective for strengthening the matrix structure of the alloy. The preferred content is 0.001 to 3 weight % for each of Ni and Fe. Though Co acts to improve the strength of the alloy by the formation of Co—Al, an excess amount of Co reduces the toughness of the alloy. Thus, the preferred content of Co is 0.001 to 2 weight %. Also, the preferred content of Sn and Sb is 0.001 to 1 weight %.

Ti is combined with harmful elements such as N and O to form oxides or nitrides. When Ti is added together with B, they form borides that function to improve the strength of the alloy. The preferred content of Ti is 0.001 to 2 weight %.

W, V, Nb, Mo and Zr act to increase the hardness of the alloy, thereby improving the wear resistance of the alloy. Because these elements are not substantially dissolved in the matrix, they are deposited as bcc crystals, effective in improving the strength of the alloy. The preferred content of each of W, V, Nb, Mo and Zr is 0.001 to 1 weight %.

Cr is an element effective in maintaining the wear resistance and the corrosion resistance of the alloy. The preferred content of Cr is 0.001 to 2 weight %.

Si acts to increase the corrosion resistance of the alloy. The preferred content of Si is 0.001 to 2 weight %.

Mg acts to remove harmful elements such as N and O and fix harmful S as sulfides, thereby improving the hot-workability and the toughness of the alloy. However, an excess amount of Mg causes the grain boundary segregation, thereby making the alloy brittle. The preferred content of Mg is 0.001 to 0.5 weight %.

P acts as a deoxidizer, improving the toughness of the alloy. The preferred content of P is 0.01 to 0.5 weight %.

Be is effective for strengthening the matrix structure of the alloy. The preferred content of Be is 0.001 to 1 weight %.

Zn acts to increase the shape memory temperature. The preferred content of Zn is 0.001 to 5 weight %.

B and C cause intergranular corrosion in the alloy to be effective for strengthening a grain boundary of the alloy. The preferred content of each of B and C is 0.001 to 0.5 weight %.

Ag acts to improve the cold-workability of the alloy. The preferred content of Ag is 0.001 to 2 weight %.

Misch metals act as a deoxidizer, improving the toughness of the alloy. The preferred content of misch metals is 0.001 to 5 weight %.

(2) Production of Copper-based Alloy (a) Cold-working

A melt of a copper-based alloy having the composition mentioned above is cast and formed into a desirable shape by hot-working, cold-working, pressing, etc. Forming just before a solution treatment is achieved by cold-working such as cold-rolling, cold-drawing, etc. A wire, plate, pipe, etc. made of the copper-based alloy, which is substantially composed of β-single phase having crystal orientation aligned in a working direction, can be obtained by repeating a cycle of annealing and cold-working to an alloy a plurality of times. The crystal orientation in the β-single phase may be improved by subjecting the cold-worked alloy to a solution treatment at least once, preferably twice.

Figure 1B:
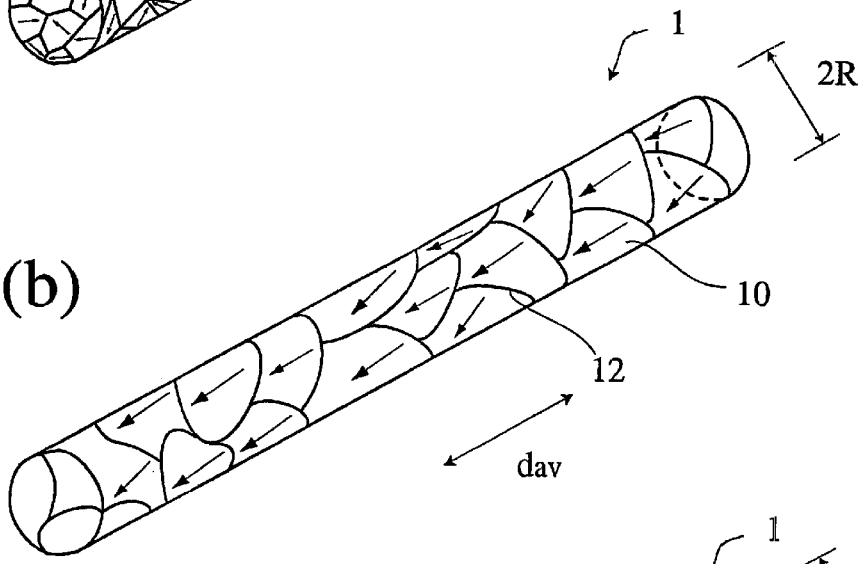
Figure 1C:
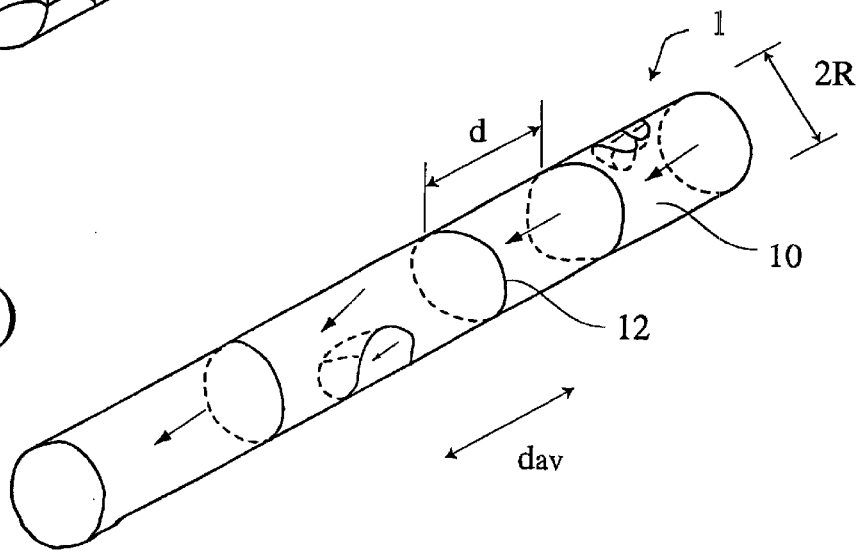

For example, with regard to the copper-based alloy wire according to the present invention, although the crystal orientation of the β-single phase is not aligned just after that an alloy is hot-drawn to form in a wire shape as shown in FIG. 1(*a*), the crystal orientation can be aligned by the solution treatment after a plurality of cold-drawings as shown in FIG. 1(*b*). Further, as shown in FIG. 1(*c*), a grain diameter d in the β-single phase is increased to be two times or more of the wire radius R by repeating the solution treatment, thereby improving the shape memory properties and superelasticity.

Figure 2A:
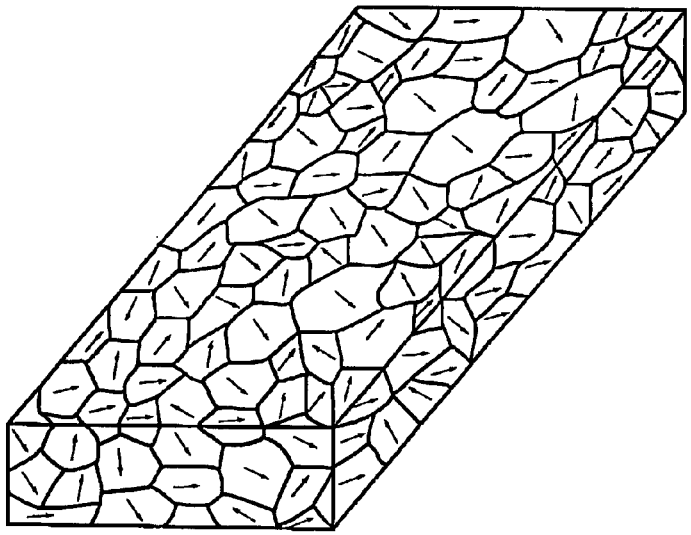
FIG. 2(*a*) is a schematic view showing a microstructure of a plate made of a copper-based alloy before cold-rolling.
Figure 2B:
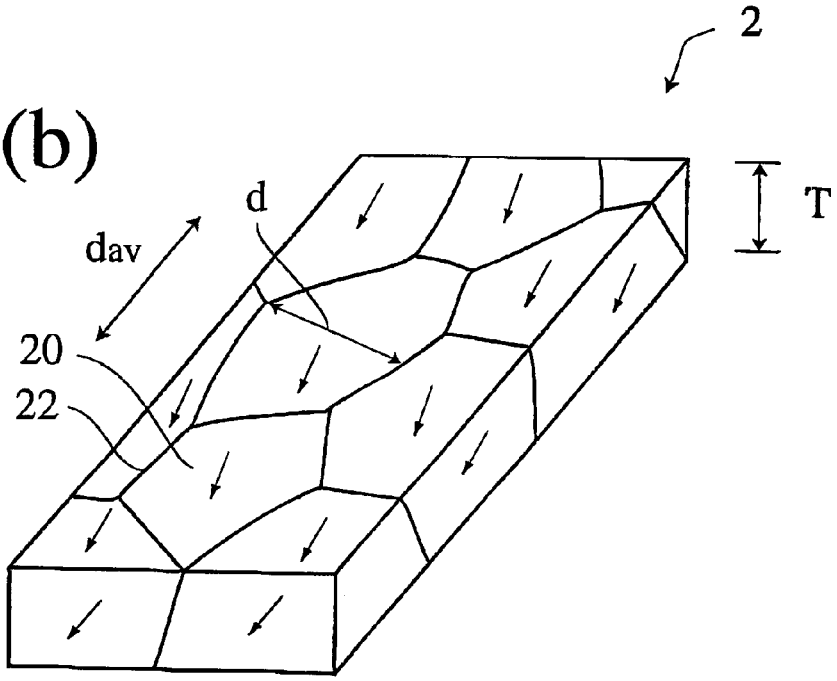

Also in the case of the plate or foil, by subjecting an alloy to cold-rolling and solution treatment a plurality of times, the crystal orientation of β-single phase is aligned in a rolling direction as shown in FIGS. 2(*a*) and (*b*). The same is true in the case of the pipe according to the present invention. The shape memory properties and superelasticity of the copper-based alloy composing the wire, plate, foil, pipe, etc. are improved by aligning its crystal orientation.

The crystal orientation of the copper-based alloy affects to its shape memory properties and superelasticity, and the better the crystal orientation is aligned, the more the shape memory properties and superelasticity are improved. Incidentally, a degree of aligning the crystal orientation is represented by "the orientation density", which is obtained by measuring <110> or <100> orientation of the β-single phase using an electron back scattering pattern method or X-ray diffraction method.

Although the higher the maximum cold-working ratio in the cold-working is, the more the crystal orientation is improved, basically, a desirable maximum cold-working ratio depends on the composition of the copper-based alloy. In the case of repeating a cycle of the annealing and cold-working to an alloy a plurality of times, the maximum cold-working ratio is a parameter defined by $[(T_0-T_1)/T_0]\times 100\%$. Incidentally, $T_0$ is a thickness of the alloy before the maximum cold-working, $T_1$ is a thickness thereof after the maximum cold-working. Wherein, the maximum cold-working is such cold-working as carried out at the maximum cold-working ratio among a plurality of cold-workings. In the case where each of the cold-workings comprises a plurality of steps, the maximum cold-working is such that the total of each working ratios in the steps is maximum. The maximum cold-working may be carried out in every cold-workings.

Figure 3A:
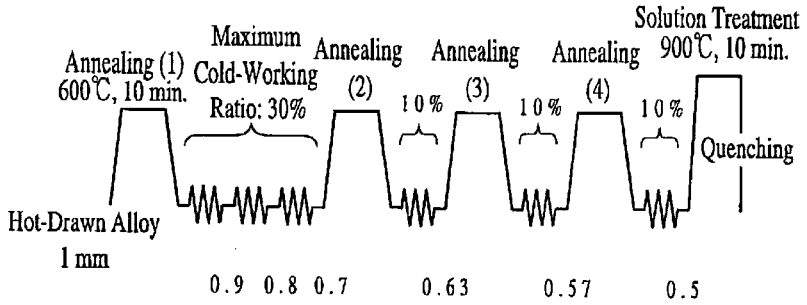
FIG. 3(*a*) is a schematic view showing an example of processes with a maximum cold-working ratio of 30% from forming to a solution treatment according to a method for producing a copper-based alloy of the present invention.
Figure 3B:
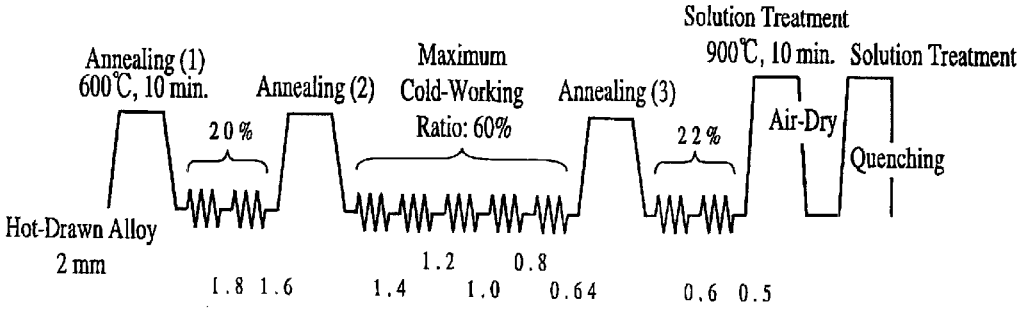
Figure 3C:
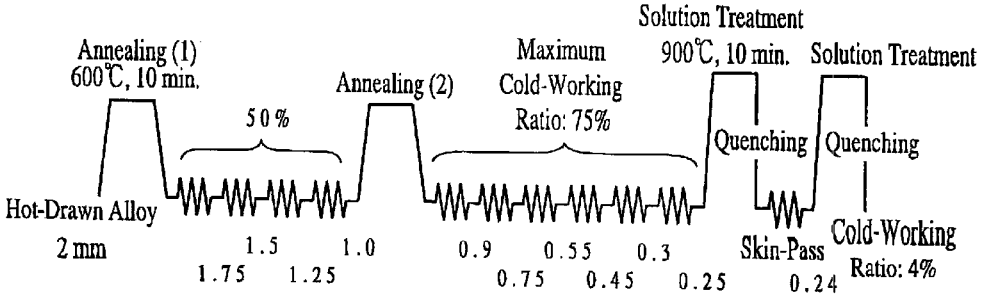

How to obtain the maximum cold-working ratio is specifically described below by reference to examples shown in FIGS. 3(*a*) to (*c*). In the case of an example shown in FIG. 3(*a*), a hot-drawn alloy is subjected to three continuous cold-workings each with a cold-working ratio of 10% after the first annealing, and subjected to a cold-working with a cold-working ratio of 10% after each of the second to forth annealing, and further subjected to the solution treatment at 900° C. for 15 minutes and the quenching. In this case, from above definition, the maximum cold-working ratio is the total of the cold-working ratios of the three continuous cold-workings after the first annealing, to be 30%. In the case of FIG. 3(*b*), the maximum cold-working ratio is the total of cold-working ratios of five continuous cold-workings carried out between the second annealing and the third annealing, to be 60%. In the case of FIG. 3(*c*), the maximum cold-working ratio is the total of cold-working ratios of six continuous cold-workings carried out between the second annealing and the A solution treatment, to be 75%. The above-mentioned definition of the maximum cold-working ratio is true in the case of the wire, pipe, etc. according to the present invention. For example in the case of the wire, the maximum cold-working ratio is obtained correspondingly to a cross sectional area in stead of the thickness.

The maximum cold-working ratio of the cold-working is 30% or more, preferably 50% or more. To obtain the crystal orientation density of the β-single phase of 2.0 or more in the cold-working direction, for example, the maximum cold-working ratio may be set to 50% or more when the copper-based alloy has a composition comprising 82.2 weight % of Cu, 8.1 weight % of Al and 9.7 weight % of Mn, or the maximum cold-working ratio may be set to 30% or more when the copper-based alloy has a composition comprising 80.4 weight % of Cu, 8.0 weight % of Al, 9.5 weight % of Mn and 2.1 weight % of Ni. When the maximum cold-working ratio in the cold-rolling is too low, the crystal orientation of the alloy is not aligned, so that the shape memory properties and superelasticity cannot be improved.

The cold-working should be carried out after transforming the microstructure of the copper-based alloy into such as comprising α-phase. By existence of the α-phase having an excellent workability, high cold-working ratio can be obtained, whereby the crystal orientation is made easy to be aligned. The alloy preferably has a microstructure comprising the α-phase of 20 volume % or more before the cold-working. Such a microstructure may be obtained by annealing, specifically composed of β+α dual phase. The annealing temperature is 450 to 800° C., and cooling after the annealing may be air-cooling. The α-phase cannot be sufficiently deposited when the annealing temperature is beyond this temperature range.

According to the copper-based alloy of the present invention, the cold-working ratio obtained by one cold-working is generally 20% or less, whereby the cold-working is needed to be carried out a plurality of times to obtain a high cold-working ratio. Before the cold-working, the alloy is subjected to annealing to transform the microstructure into such as comprising the α-phase. As described above, the alloy can be formed into a desired shape by repeating a cycle of annealing and cold-working thereto twice or more. The shape memory properties and superelasticity of the alloy may be improved by setting the total of the cold-working ratios to 30% or more in at least one cycle.

(b) Solution Treatment

The cold-worked, copper-based alloy is then subjected to a solution treatment with a temperature range at which its microstructure is transformed into β-single phase. According to a preferred embodiment of the present invention, after the solution treatment, the alloy may be maintained in a temperature at which its microstructure is transformed into the β+α dual phase structure, or the alloy may be cooled down to deposit the α-phase and then subjected to another solution treatment. The shape memory properties and superelasticity of the alloy are extremely improved by one, or two or more solution treatment. This seems such an effect as obtained because the alloy is cooled down to transform the β-single phase thereof into the β+α dual phase, whereby deposited α-phase acts to improve the crystal orientation of the final β-phase obtained by another solution treatment.

Although the temperature at which the microstructure of the alloy is transformed into the β-single phase or β+α dual phase depends on the composition of the alloy, in general, the temperature to form the β-single phase is 700 to 950° C. and the temperature to form the β+α dual phase is 400 to 850° C. The alloy is maintained at the temperature to form the β-single phase for 0.1 minute or more. The maintaining time is preferably 0.1 to 15 minutes because the alloy is affected by oxidation when it exceeds 15 minutes. The cooling to transform the β-single phase into the β+α dual phase may be air-cooling.

As shown in FIG. 3(*c*), in the case where the solution treatments are repeatedly carried out a plurality of times, skin-pass applying a strain of 5 to 20% to the alloy may be carried out between each solution treatment at room temperature. The skin-pass makes the crystal orientation of the alloy be easily aligned.

The solution treatment may be carried out while stressing. Such a treatment, so-called tension-annealing, enables to precisely control the shape memory properties of the copper-based alloy. The stress is preferably 0.1 to 10 kgf/mm$^2$.

(c) Quenching

After the solution treatment, the alloy is subjected to rapid cooling to freeze the β-single phase structure. The rapid cooling may be carried out by immersing in a cooling-medium such as water, mist-cooling or forced-air cooling. When the cooling-speed is too low, the deposition of the α-phase takes place in the alloy, failing to maintain the alloy in a state having only the β-phase microstructure. The cooling speed is preferably 50° C./second or more, practically preferably 100 to 1000° C./second.

(d) Aging Treatment

According to the present invention, it is preferable that the aging treatment is carried out after the quenching. The aging temperature is lower than 300° C., preferably 100 to 250° C. If the aging temperature were too low, the β-phase would be unstable, making it likely for the martensitic transformation temperature to change when left at room temperature. On the other hand, when the aging temperature is more than 250° C., the α-phase may be deposited to significantly reduce the shape memory properties and superelasticity.

The aging time in general is preferably 1 to 300 minutes, particularly 5 to 200 minutes, though it may vary depending on the composition of the alloy. Less than 1 minute of aging would not provide sufficient aging effects. On the other hand, when the aging time is longer than 300 minutes, the α-phase may be deposited to reduce the shape memory properties and superelasticity.

(3) Microstructure

The copper-based alloy of the present invention has a recrystallized structure substantially composed of β-single phase having crystal orientation such as <110> orientation, <100> orientation, etc. aligned in a direction of the cold-working such as cold-rolling and cold-drawing. The crystal orientation density in the working direction, which represents a degree of aligning the crystal orientation, is 2.0 or more, preferably 2.5 or more. The density is measured by an electron back scattering pattern method or an X-ray diffraction method. The orientation density f(g) is represented by the following equation.

$$f(g)\cdot V=dV/dg$$

wherein, V is a total volume of the crystal grains, g is a crystal orientation, dV/dg is a volume of the crystal grains contained in an infinitely small area dg in the crystal orientation g.

For example, <110> density in the working direction is represented by a probability of the <110> orientation existing in the working direction. The <110> density is 0 when the <110> orientation is not exist in the working direction, 1 when the <110> orientation is random, and ∞ when the <110> orientation is completely aligned to the working direction. The more the orientation density is, the more the crystal orientation is aligned in the direction. When the density is less than 2.0, the copper-based alloy cannot have excellent shape memory properties and superelasticity.

The orientation density f(g) in the recrystallized structure may be further improved by the solution treatments repeatedly carried out a plurality of times.

(4) Properties (a) Superelasticity

The copper-based alloy according to the present invention, in which the crystal orientation is aligned, has more excellent superelasticity than that of the conventional copper-based alloys. If to the copper-based alloy of the present invention is applied strain of 5%, the alloy shows a shape recovery ratio of 90% or more after elimination of straining. In particular, in the case where the solution treatment is carried out twice or ore, the copper-based alloy shows a shape recovery ratio of 90% or more even if strain of 8% is applied thereto. Incidentally, the shape recovery ratio is represented by the following equation:

$$\text{Shape recovery ratio (\%)}=100\times(\text{Applied strain}-\text{Residual strain})/\text{Applied strain}$$

(b) Shape memory properties

The copper-based alloy of the present invention has excellent shape memory properties to show a shape recovery ratio of 95% or more, substantially 100%.

[2] Members Made of Copper-based Alloy

The copper-based alloy according to the present invention is excellent in hot-workability and cold-workability to achieve a cold-working ratio of 20 to 90% or more. This enables the alloy to be formed into extremely thin wires, foils, springs, pipes, etc., being conventionally difficult.

The shape memory properties of the copper-based alloy depends on not only its microstructure, but also the size of crystal grains. For example, in the case of the wire or plate, the shape memory properties and superelasticity is remarkably improved when the average grain diameter of the crystal grains is equal to or more than the wire diameter R or the plate thickness T. In such a case, the crystal orientation is improved by surface energy, which affects crystal grain growth to secondary recrystallize the grains, as shown in FIGS. 1 and 2.

(1) Wire

As shown in FIGS. 1(*b*) and (*c*), the average grain diameter $d_{av}$ of the crystal grains 10 in the wire 1 is equal to or more than the wire radius R, preferably equal to or more than 2R. When the relation between the average grain diameter $d_{av}$ and the wire radius R satisfies $d_{av}\geqq 2R$ as shown in FIG. 1(*c*), the alloy has a microstructure where the grain boundaries 12 are located like a bamboo joint, whereby its crystal orientation is improved by the surface energy.

Even if the average grain diameter da meets the condition, $d_{av}\geqq R$ or $d_{av}\geqq 2R$, the crystal grains have a grain diameter distribution so that crystal grains may be existed with a diameter d less than the radius R. Although such a crystal grains having a diameter d less than the radius R merely affects the properties of the copper-based alloy, a region of the wire 1, in which the copper-based alloy has a grain diameter d equal to or more than the radius R, has a length of preferably 30% or more, more preferably 60% or more based on the entire length of the wire to obtain excellent shape memory properties and superelasticity.

The radius R of the wire 1 may be arbitrarily set in a range of 0.01 to 3 mm. For example, a plurality of thin wires each having a diameter of 1 mm or less may be intertwined to form a twisted wire. The twisted wire may be used as an antenna of a cellular phone, etc. Further, the thin wire having a diameter of 0.2 to 1 mm may be used as a guide wire for a catheter, etc. Furthermore, the wire 1 according to the present invention may be formed in a spring.

Repetition of the solution treatment affects to make the crystal grains of the thin wire grow to have a sufficiently larger diameter than the wire radius, whereby the microstructure of the thin wire can be substantially composed of a single microstructure.

Figures 4A, 4B, 4C:
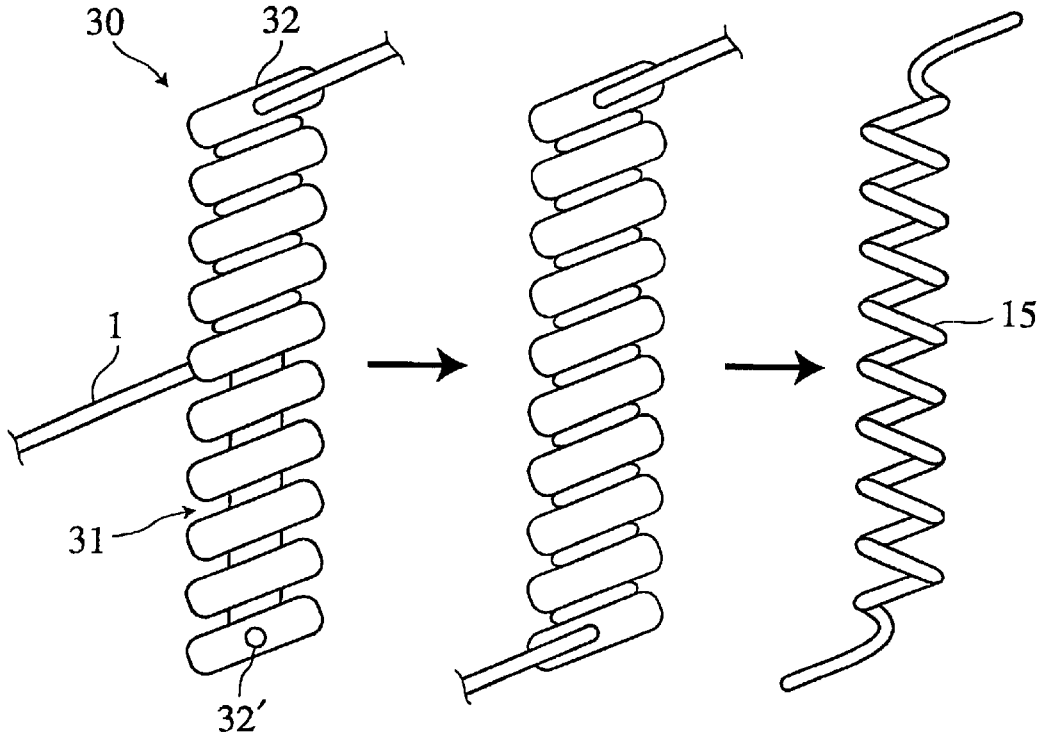
FIG. 4 is a schematic view showing a production of a spring made of a copper-based alloy according to the present invention.

As the other application example of the wire 1, a method for producing a spring is described below. First, a wire 1 is passed through an aperture 32 provided in one end of a rod 30 having spiral groove 31 as shown in FIG. 4(*a*), and the wire 1 is winded on the groove 31 and passed through an aperture 32' provided in the other end of the rod 30 to prevent the wire 1 from losing its form as shown in FIG. 4(*b*). The resultant wire 1 is subjected to a solution treatment at 800 to 950° C. for approximately 5 minutes in the air, and air-dried while keeping the above form. Then, the dried wire is subjected to another solution treatment at 800 to 950° C. for approximately 5 minutes in the air, rapidly quenched by immersion in water, and then subjected to a quenching and aging treatment. Thereafter, the wire 1 is subjected to another aging treatment at a low temperature of 100 to 200° C., and the resultant spring 15 is removed from the rod 30 after properly controlling an Ms temperature (a martensitic transformation temperature) as shown in FIG. 4(*c*). Thus-obtained spring made of the copper-based alloy has excellent shape memory properties and superelasticity.

(2) Plate

In the plate 2 shown in FIG. 2(*b*), each crystal grain 20 is not influenced by the grain boundary 22 in the surface of the plate 2. The average grain diameter $d_{av}$ of the crystal grains 20 is equal to or more than the plate thickness T. It is preferable that the relation between the average grain diameter $d_{av}$ and the plate thickness T is represented by $d_{av}\geqq 2T$. As well as the wire 1, the crystal orientation is improved by surface energy when the average grain diameter da is equal to or more than the plate thickness T. Thus, the copper-based alloy plate 2 meeting the condition of $d_{av}\geqq T$ exhibits excellent shape memory properties and superelasticity.

As well as the wire 1, even if the average grain diameter $d_{av}$ meets. the condition, $d_{av}\geqq T$ or $d_{av}\geqq 2T$, the crystal grains have a grain diameter distribution so that crystal grains may be existed having a diameter d less than the plate thickness T. A region of the plate 2, in which the copper-based alloy has a grain diameter d equal to or more than the plate thickness T, has an area of preferably 30% or more, more preferably 60% or more based on the entire area of the plate to obtain excellent shape memory properties and superelasticity.

The thickness T of the plate 2 may be properly set in a range of 0.01 to 3 mm. The plate 2 has an excellent superelasticity, thereby being usable for springs, connector members, clips, etc.

Repetition of the solution treatment affects to make the crystal grains of the thin plate or foil grow to have a sufficiently larger diameter than the thickness of the plate or foil, whereby the microstructure thereof can be substantially composed of a single microstructure.

(3) Method for Producing Wire, Plate and Foil

The wire 1 may be produced by a method comprising the steps of: forming an alloy by hot-drawing in a relatively thick wire shape; repeating a cycle of annealing and cold-working such as cold-drawing to the formed alloy a plurality of times to form it into a thin wire shape, a maximum cold-working ratio being 30% or more in the cold-working; and subjecting the cold-worked alloy to a solution treatment at least once, quenching to maintain the β-single phase structure and an aging treatment. On the other hand, the plate 2 may be produced by a method comprising the steps of: forming an alloy by hot-drawing; repeating a cycle of annealing and cold-working such as cold-rolling to the formed alloy a plurality of times, a maximum cold-working ratio being 30% or more in the cold-working; forming the cold-worked alloy by punching or pressing in a desired shape; and subjecting the punched or pressed alloy to a solution treatment at least once, quenching to maintain the β-single phase structure and an aging treatment. The foil according to the present invention may be produced in the same manner as the plate.

The present invention will be described in more detail below with reference to the following examples without intention of restricting the scope of the present invention.

EXAMPLES 1 TO 3, COMPARATIVE EXAMPLE 1

Copper-based alloys having a composition comprising 80.4 weight % of Cu, 8.0 weight % of Al, 9.5 weight % of Mn and 2.1 weight % of Ni were melted, and solidified at a cooling rate of 140° C./minute on average to form billets having a diameter of 20 mm. The each billet was formed by hot-drawing at 850° C. in a plate shape having a thickness of 2.5 mm. To each of the drawn billets was repeated a cycle of annealing at 600° C. for 10 minutes followed by air-cooling and cold-rolling a several times to produce plates having a length of 100 mm, a width of 10 mm and a thickness of 0.2 mm. Annealing and working conditions, and a maximum cold-working ratio according to each plate are shown in Tables 1*a* and 1*b*. The annealing was carried out at 600° C. for 10 minutes and followed by air-cooling, and a volume ratio of α-phase was 70% based on the entire alloy at the final cold-working. The each plate was solution-treated at 900° C. for 15 minutes, rapidly cooled by immersion in water with ice, and then subjected to an aging treatment at 200° C. for 15 minutes. The obtained plates were subjected to the following measurements.

(1) Measurement of Electron Back Scattering Pattern

Figure 5:
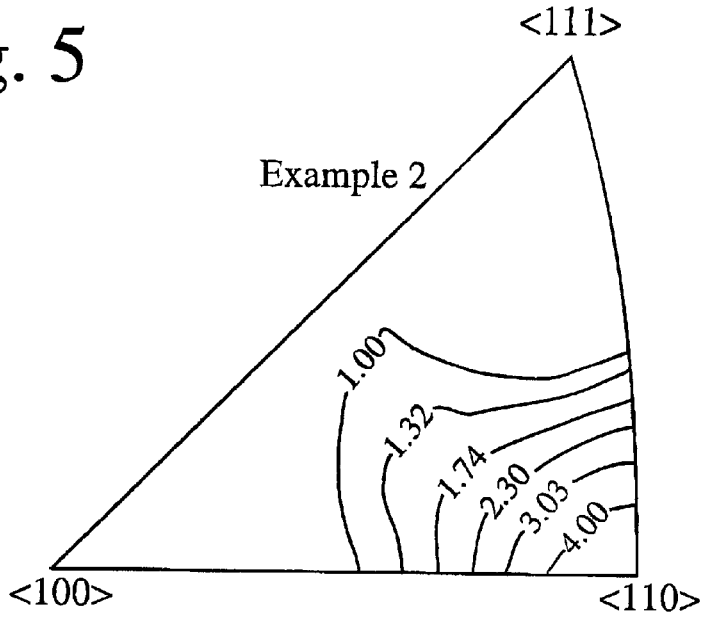
FIG. 5 is an inverse pole figure showing the crystal orientation density of β-single phase in a rolling direction according to a copper-based alloy plate of Example 2 by contours.
Figure 6:
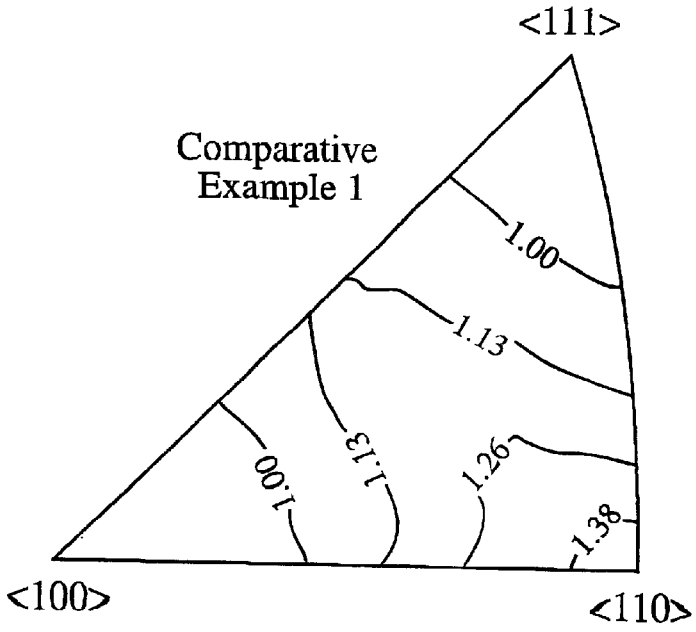
FIG. 6 is an inverse pole figure showing the crystal orientation density of β-single phase in a rolling direction according to a copper-based alloy plate of Comparative Example 1 by contours.

Each of the obtained plates was measured with respect to the crystal orientation density of β-phase in the cold-rolling direction by an electron back scattering pattern-measuring device, "Orientation Imaging Microscope" manufactured by TexSEM Laboratories, Inc. (TSL). FIG. 5 is an inverse pole figure showing the crystal orientation density in the rolling direction according to the plate of Example 2 by contours, and FIG. 6 is an inverse pole figure showing the crystal orientation density in the rolling direction according to the plate of Comparative Example 1 by contours. In FIG. 5, the contours are gathered in <110> orientation, thus, so that it is clear that the <110> orientation in the plate of Example 2 is aligned in the rolling direction. The <110> orientation density was 5.0 in the rolling direction. On the other hand, as shown in FIG. 6, the crystal orientation of the microstructure composing the plate of Comparative Example 1 is almost random, the <110> orientation density being 1.5 in the rolling direction. The <110> orientation density in the rolling direction according to each of the plates of Examples 1 to 3 and Comparative Example 1 is also shown in Table 1*b*.

(2) Measurement of Shape Recovery Ratio Based on Superelasticity

Figure 7:
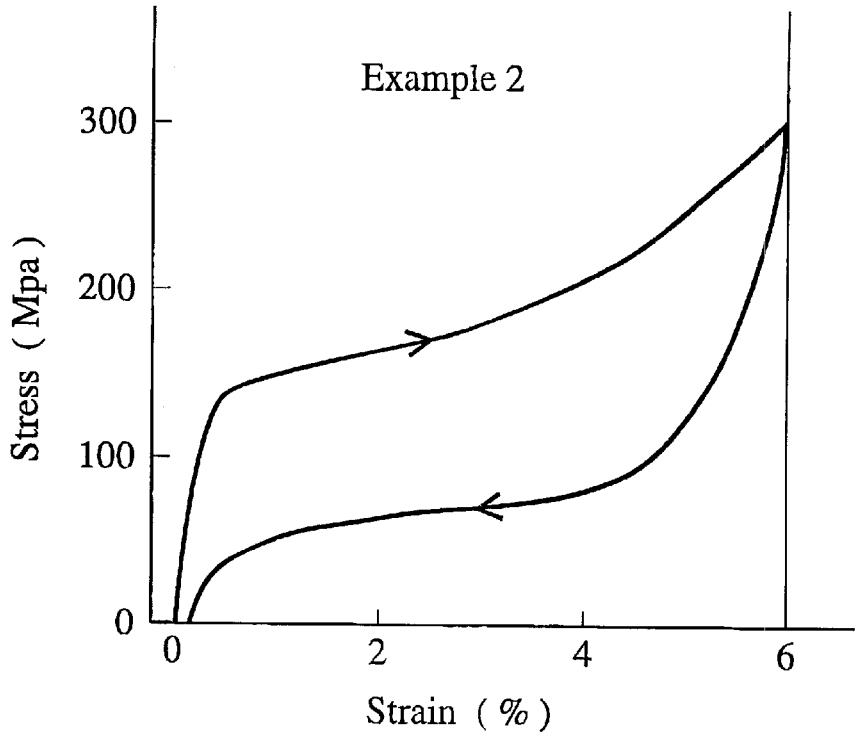
FIG. 7 is a graph showing a stress-strain curve according to a copper-based alloy plate of Example 2.
Figure 8:
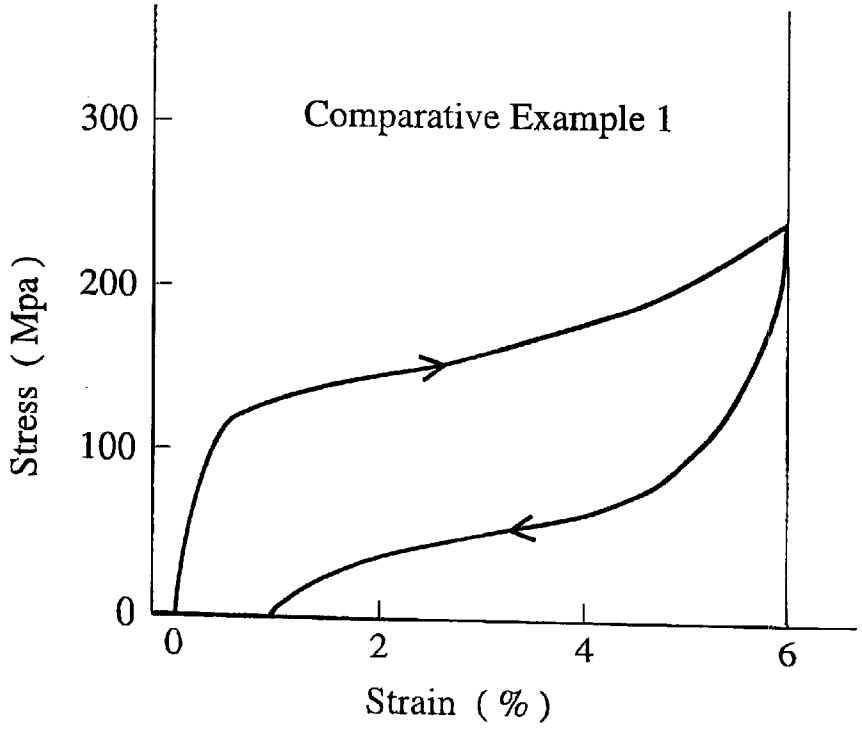
FIG. 8 is a graph showing a stress-strain curve according to a copper-based alloy plate of Comparative Example 1.

A stress-strain hysteresis was provided according to each of the above plates. FIG. 7 is a graph showing a relation of stress-strain according to the plate of Example 2, and FIG. 8 is a graph showing a relation of stress-strain according to the plate of Comparative Example 1. The shape recovery ratio of each plate was calculated by the following equation: Shape recovery ratio (%)=100×(Applied strain—Residual strain)/Applied strain, using the stress-strain curve. The shape recovery ratio in the case of applied strain of 6% according to each plate is also shown in Table 1.

TABLE 1a

Annealing and working conditions

| Example No. | Processes |
|---|---|
| Ex. 1 | Annealing (600° C., 10 minutes) → Three cold-workings (30%: Maximum cold-working ratio) → Annealing (600° C., 10 minutes) → Cold-working (10%) → Annealing (600° C., 10 minutes) → Cold-working (10%) → Solution treatment (900° C., 10 minutes) → Quenching → Aging treatment (200° C., 15 minutes) |
| Ex. 2 | Annealing (600° C., 10 minutes) → Two cold-workings (20%) → Annealing (600° C., 10 minutes) → Five cold-workings (50%: Maximum cold-working ratio) → Annealing (600° C., 10 minutes) → Three cold-workings (30%) → Solution treatment (900° C., 10 minutes) → Quenching → Aging treatment (200° C., 15 minutes) |
| Ex. 3 | Annealing (600° C., 10 minutes) Five cold-workings (50%) → Annealing (600° C., 10 minutes) → Six cold-workings (75%: Maximum cold-working ratio) → Solution treatment (900° C., 10 minutes) → Quenching → Aging treatment (200° C., 15 minutes) |
| Comp. Ex. 1 | Annealing (600° C., 10 minutes) → Cold-working (10%) → Annealing (600° C., 10 minutes) → Two cold-workings (20%: Maximum cold-working ratio) → Solution treatment (900° C., 10 minutes) → Quenching → Aging treatment (200° C., 15 minutes) |

TABLE 1b

Maximum cold-working ratio and properties of plate

| Example No. | Maximum cold-working ratio (%) | <110> orientation density in rolling direction | Shape recovery ratio (%, Applied strain: 6%) |
|---|---|---|---|
| Ex. 1 | 30 | 2.8 | 90 |
| Ex. 2 | 50 | 5 | 97 |
| Ex. 3 | 75 | 5.2 | 97 |
| Comp. Ex. 1 | 20 | 1.5 | 82 |

As shown in Tables 1*a* and 1*b*, in the plates of Examples 1 to 3 with the maximum cold-working ratio of 30% or more, the <110> orientation density was 2.0 or more in the rolling direction to exhibit that the <110> orientation was aligned in the rolling direction. Additionally, the plates of Examples 1 to 3 exhibited the shape recovery ratio of 90% or more. In contrast, in the plate of Comparative Example 1 with the maximum cold-working ratio of 20%, the <110> orientation density was 1.5 in the rolling direction to exhibit that the <110> orientation was almost random, and the shape recovery ratio was 82%, less than 90%. As was clear from these results, the copper-based alloy produced with a high maximum cold-working ratio had the crystal orientation aligned in the cold-working direction, and exhibited an excellent superelasticity.

Figure 9A:
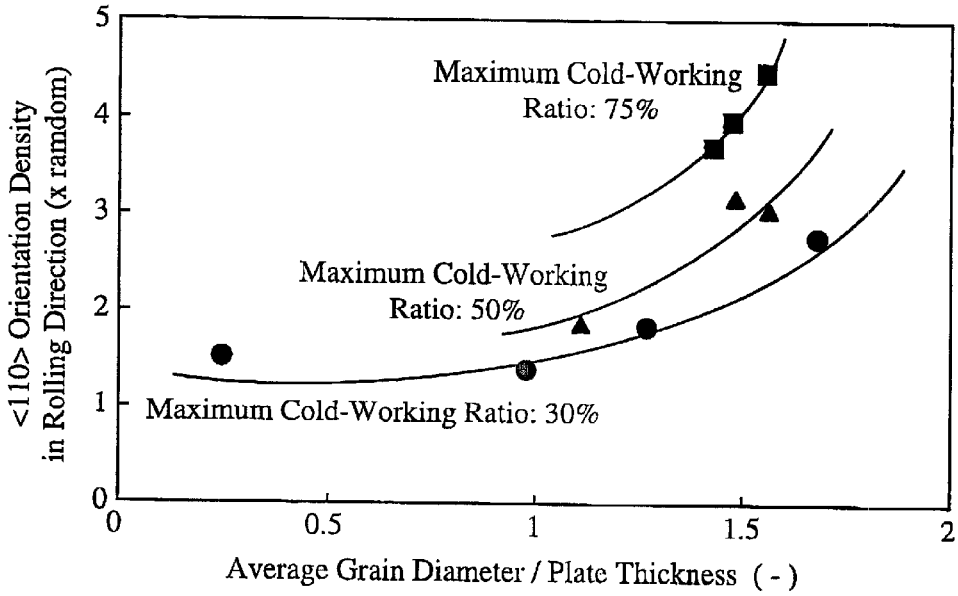
FIG. 9(*a*) is a graph showing a relation corresponding to various maximum cold-working ratios between a ratio of average grain diameter/plate thickness and the <110> orientation density in a rolling direction according to copper-based alloy plates of Examples 1 to 3.
Figure 9B:
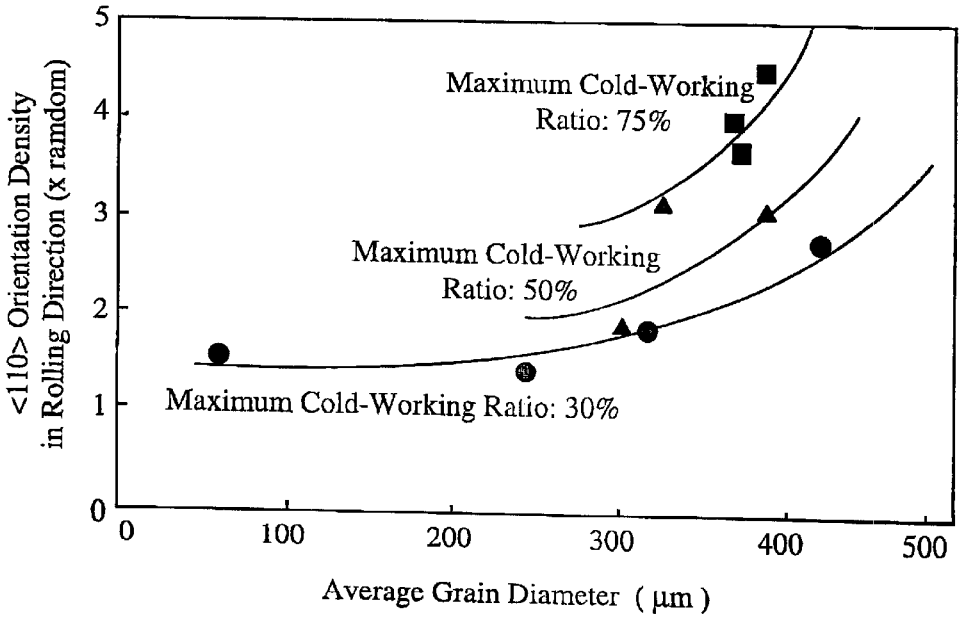

Plates having ratio of average grain diameter/plate thickness different from each other were obtained by repeating a cycle of annealing and cold-working to an alloy a plurality of times, respectively. Each of the obtained plates was measured with respect to the <110> orientation density in the cold-rolling direction. The results are shown in FIG. 9. As shown in FIG. 9(*a*), the <110> orientation density is increased as the ratio of average grain diameter/plate thickness become larger at a fixed maximum cold-working ratio. Additionally, the higher maximum cold-working ratio is, the higher the <110> orientation density becomes. As shown in FIG. 9(*b*), the same was true in the relation between the average grain diameter and the <110> orientation density.

EXAMPLE 4, COMPARATIVE EXAMPLE 2

Copper-based alloys having a composition comprising 82.2 weight % of Cu, 8.1 weight % of Al and 9.7 weight % of Mn were melted, having a diameter of 20 mm. Each billet was formed by hot-drawing at 850° C. in a plate shape having a thickness of 3 mm. To each of the drawn billet was repeated a cycle of annealing at 600° C. for 10 minutes followed by air-cooling and a plurality or cold-rollings three times to produce plates having a length of 100 mm, a width of 10 mm and a thickness of 0.2 mm, respectively. The annealing was carried out at 600° C. for 10 minutes and a volume ratio of α-phase was 70% based on the entire alloy in the final cold-working. The maximum cold-working ratio in the cold-rolling is shown in Table 2. Each of the resultant plates was solution-treated at 900° C. for 10 minutes, rapidly cooled by immersion in water with ice, and then subjected to an aging treatment at 200° C. for 15 minutes.

Each of the obtained plates was measured with regard to the electron back scattering pattern, and a stress-strain curve thereof was obtained in the same manner as Example 1. The <110> orientation density in the rolling direction, and the shape recovery ratio in the case of applied strain of 5% according to each plate are shown in Table 2.

TABLE 2

Maximum cold-working ratio and properties of plate

| Example No. | Maximum cold-working ratio (%) | <110> orientation density in rolling direction | Shape recovery ratio (%, Applied strain: 5%) |
|---|---|---|---|
| Ex. 4 | 50 | 3.3 | 90 |
| Comp. Ex. 2 | 25 | 1.3 | 81 |

As shown in Table 2, in the plate of Example 4 with the maximum cold-working ratio of 50% or more, the <110> orientation density was 3 or more in the rolling direction to exhibit that the <110> orientation was aligned in the rolling direction, and the plate of Example 4 exhibited the shape recovery ratio of 90%. In contrast, in the plate of Comparative Example 2 with the maximum cold-working ratio of less than 30%, the <110> orientation density was 1.3 in the rolling direction to exhibit that the <110> orientation was almost random, and the shape recovery ratio was 81%.

EXAMPLES 5 TO 8, COMPARATIVE EXAMPLE 3

The copper-based alloys equal to that used in Example 3 were formed by hot-drawing in the same manner as Example 3 into a plate shape having a thickness of 3 mm. Then, to the drawn alloys was repeated a cycle of annealing at 600° C. for 10 minutes followed by air-cooling and a plurality of cold-rolls twice, to produce plates each having a length of 100 mm, a width of 10 mm and a thickness of 0.2 mm, respectively. The final annealing was carried out at a temperature shown in Table 3 to control a volume ratio of α-phase based on the entire alloys into such as shown in Table 3. The maximum cold-working ratio was 75%. Each of the resultant plates was solution-treated at 900° C. for 10 minutes, rapidly cooled by immersion in water with ice, and then subjected to an aging treatment at 200° C. for 15 minutes. Each copper-based alloy plate was measured with regard to the <110> orientation density in the rolling direction and the shape recovery ratio (%) in the case of applied strain of 4%, in the same manner as Example 3. The results are shown in Table 3.

TABLE 3

Working conditions and properties of plate

| Example No. | Final annealing temperature (° C.) | Volume ratio of α-phase (%) | <110> orientation density in rolling direction | Shape recovery ratio (%, Applied strain: 4%) |
|---|---|---|---|---|
| Ex. 5 | 550 | 80 | 4.4 | 95 |
| Ex. 6 | 600 | 70 | 3.9 | 97 |
| Ex. 7 | 700 | 45 | 4.3 | 95 |
| Ex. 8 | 800 | 18 | 3.0 | 95 |
| Comp. Ex. 3 | 900 | 0 | 1.5 | 82 |

As is clear from Table 3, the superelasticity of the copper-based alloy is affected by the volume ratio of α-phase in the cold-working after the final annealing. In the plates of Examples 5 to 8 having the α-phase volume ratio of 18% or more, the <110> orientation density was 2 or more in the rolling direction to exhibit that the <110> orientation was aligned in the rolling direction, and the shape recovery ratio was 90% or more. In contrast, in the plate of Comparative Example 3 comprising substantially no α-phase, the <110> orientation density was 1.5 in the rolling direction to exhibit that the <110> orientation was almost random, and the shape recovery ratio was 82%.

EXAMPLES 9 AND 10

From copper-based alloys each having a composition shown in Table 4, plates having a length of 100 mm, a width of 10 mm and a thickness of 0.2 mm were produced in the same manner as Example 2, respectively. Wherein, the final annealing temperature was 600° C., and the maximum cold-working ratio in the cold-rolling carried out three times was 50%. Each of the resultant plates was solution-treated at 900° C. for 5 minutes, air-cooled beyond 800° C., and subjected to a solution treatment at 900° C. for 10 minutes. Then, each plate was rapidly cooled by immersion in water with ice, and subjected to an aging treatment at 200° C. for 15 minutes.

TABLE 4

| Composition of copper-based alloy (weight %) | | | | | | |
|---|---|---|---|---|---|---|
| Example No. | Cu | Al | Mn | Co | Ni | Cr |
| Ex. 9 | 81.2 | 8.1 | 10.2 | 0.5 | — | — |
| Ex. 10 | 79.0 | 7.8 | 9.3 | — | 2.1 | 1.8 |

Figure 10:
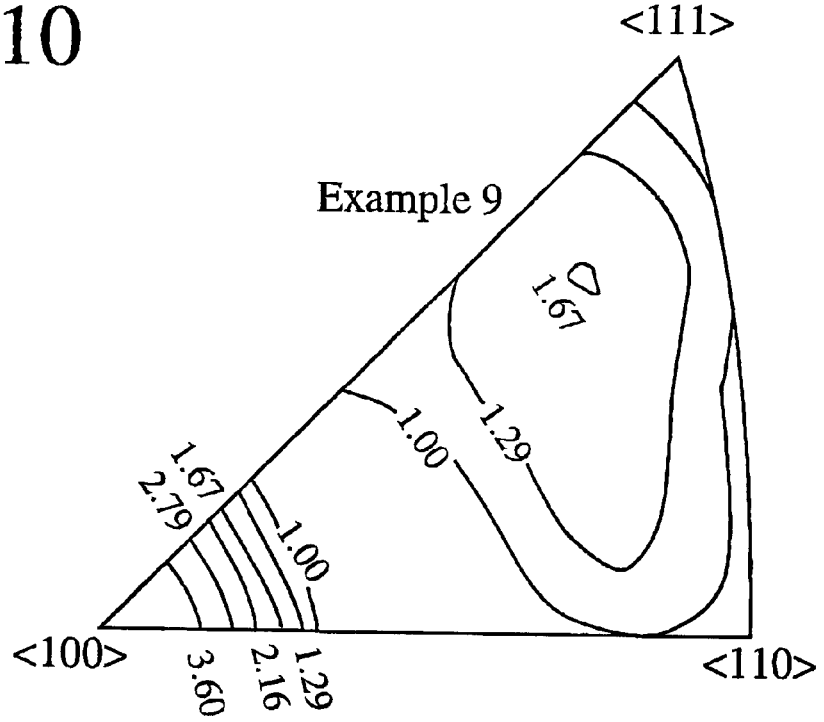
FIG. 10 is an inverse pole figure showing the crystal orientation density of β-single phase in a rolling direction according to a copper-based alloy plate of Example 9 by contours.

Each of the obtained copper-based alloy plates was measured with regard to the crystal orientation density in the rolling direction in the same manner as Example 2. FIG. 10 is an inverse pole figure showing the density according to a copper-based alloy plate of Example 9 by contours, obtained by measuring its electron back scattering pattern. The contours in FIG. 10 are gathered in <100> orientation, this showing that the <100> orientation of the plate according to Example 9 is aligned in the rolling direction. The <100> orientation density was 4.5 in the rolling direction.

Each of the obtained copper-based alloy plates was measured with respect to the shape recovery ratio after straining and eliminating the strain in the same manner as Example 2. The results are shown in Table 5a. For comparison, this measurement was repeated to each of plates obtained in the same manner as Examples 9 and 10 except that the solution treatment was carried out only once. The results are shown in Table 5b.

TABLE 5a

| Shape recovery ratio of copper-based alloy plate subjected to solution treatment twice | | | | |
|---|---|---|---|---|
| Example No. | Applied strain (%) | Shape recovery ratio (%) | Grain diameter (μm) | Orientation density |
| Ex. 9 | 7 | 98 | 1542 | 4.54 <100> |
| Ex. 10 | 6 | 90 | 1000 | 5.11 <110> |

TABLE 5b

| Shape recovery ratio of copper-based alloy plate subjected to solution treatment once | | | | |
|---|---|---|---|---|
| Example No. | Applied strain (%) | Shape recovery ratio (%) | Grain diameter (μm) | Orientation density |
| Ex. 9 | 7 | 83 | 476 | 2.1 <100> |
| Ex. 10 | 6 | 52 | 137 | 1.8 <110> |

As shown in Tables 5a and 5, the grain diameter and the <100> or <110> orientation density were increased by subjecting the plate to solution treatment twice. Also, the superelasticity of the plate was extremely improved by two solution treatments in the both case where 7% and 6% of train was applied to the plate.

EXAMPLE 11

Copper-based alloys having compositions shown in Table 6 as Sample Nos. 1 to 4 were melted, and solidified at a cooling rate of 140° C./minute on average to form billets each having a diameter of 20 mm. Each billet was formed by hot-drawing in a plate shape having a thickness of 3 mm. To each drawn alloy was repeated a cycle of annealing at 600° C. for 10 minutes followed by air-cooling and a plurality of cold-rollings three times to produce a plate having a length of 100 mm, a width of 10 mm and a thickness of 0.2 mm. The final annealing was carried out at 600° C. for 10 minutes, and the maximum cold-working ratio in the cold-rolling was 50%. Each of the resultant plates was solution-treated at 900° C. for 10 minutes, rapidly cooled by immersion in water with ice, and then subjected to an aging treatment at 200° C. for 15 minutes.

Each plate was wound around a rod having a diameter of 20 mm to be applied 2% of strain in its surface. This was immersed in liquid nitrogen, and measured with respect to a curvature radius $R_0$ after taken out of the liquid nitrogen. The curved plate was then heated to 200° C. to recover its original shape, and measured with respect to a curvature radius $R_1$. The shape recovery ratio of each plate was calculated by the formula: Shape recovery ratio (%)=$100\times(R_1-R_0)/R_1$. The calculated shape recovery ratios are shown in Table 6. As is clear from Table 6, the copper-based alloy according to the present invention exhibits the shape recovery ratio of 95% or more to have excellent shape memory properties.

TABLE 6

| Composition of copper-based alloy and shape recovery ratio | | | | | |
|---|---|---|---|---|---|
| Sample | Composition (weight %) | | | | Shape recovery ratio |
| No. | Cu | Al | Mn | Others | (%) |
| 1 | 82.2 | 8.1 | 9.7 | — | 95 |
| 2 | 79.0 | 7.8 | 9.3 | Ni: 2.1, Cr: 1.8 | 100 |
| 3 | 81.2 | 8.1 | 10.2 | Co: Os.5 | 100 |
| 4 | 80.4 | 8.0 | 9.5 | Ni: 2.1 | 100 |

EXAMPLE 12 copper-based alloy having a composition comprising 81.3 weigh % of Cu, 8.0 weight % of Al, 9.6 weight % of Mn and 1.1 weight % of Ni was melted, and solidified at a cooling rate of 140° C./minute on average to form a billet having a diameter of 20 mm. The billet was formed by hot-drawing at 850° C. in a wire shape having a diameter of 3 mm. To the drawn billet was repeated a cycle of annealing at 600° C. for 10 minutes followed by air-cooling and a plurality of cold-drawings three times to produce a wire having a diameter of 0.36 mm. The resultant wire was solution-treated at 900° C. for 5 minutes, air-cooled, subjected to a solution treatment at 900° C. for 5 minutes, rapidly cooled by immersion in water with ice, and quenched. Thus-obtained wire is shown in FIG. 11 as a microphotograph of a microstructure.

Figure 11:
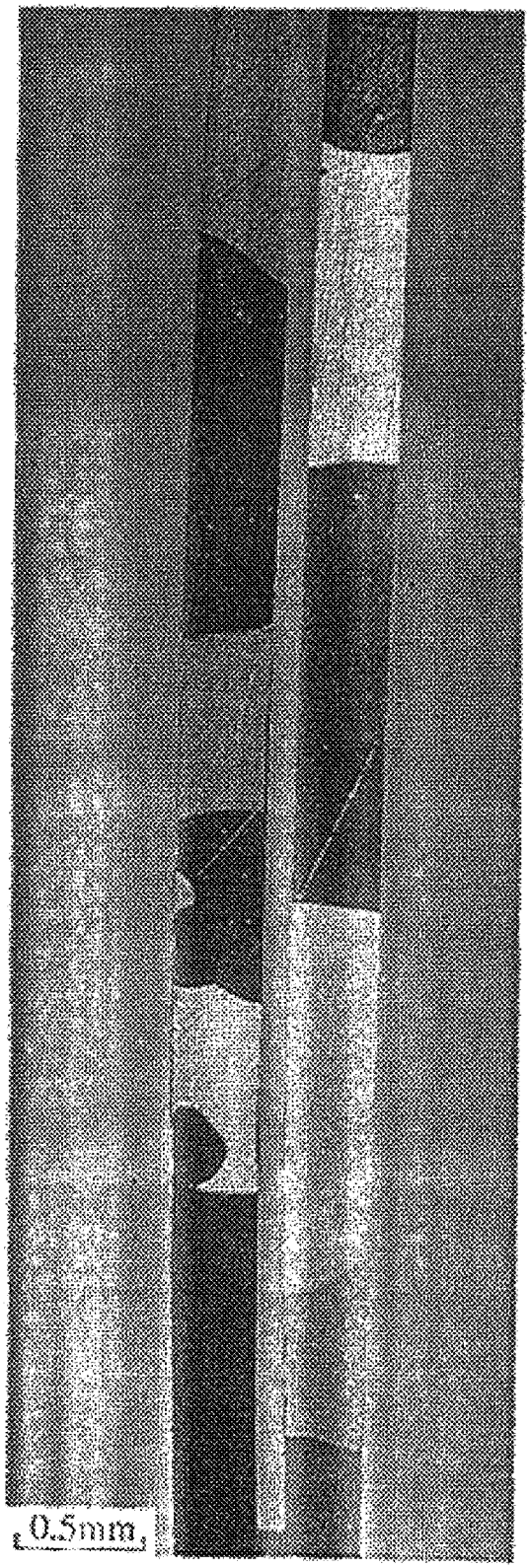
FIG. 11 is a microphotograph showing a microstructure of copper-based alloy wire according to the present invention.

As shown in FIG. 11, the crystal grain diameter d was equal to or more than the wire diameter 2R, so that the wire had a microstructure where the grain boundaries were located like a bamboo joint, so-called bamboo structure.

The billets equal to that used in Example 12 were formed by melting and solidifying, and were hot-drawn in the same manner as Example 12. Then, to each of the drawn billets was repeated a cycle of annealing at 600° C. for 10 minutes followed by air-cooling and a plurality of cold-drawings a plurality of times, to produce wires having a ratio of grain diameter/wire diameter different from each other. Each wire was solution-treated at 900° C. for 5 minutes, air-cooled, subjected to another solution treatment at 900° C. for 5 minutes, air-cooled if necessary, immersed in water with ice, and quenched. The obtained wires were evaluated with respect to a relation between a ratio of average grain diameter/wire diameter and the shape recovery ratio.

Figure 12A:
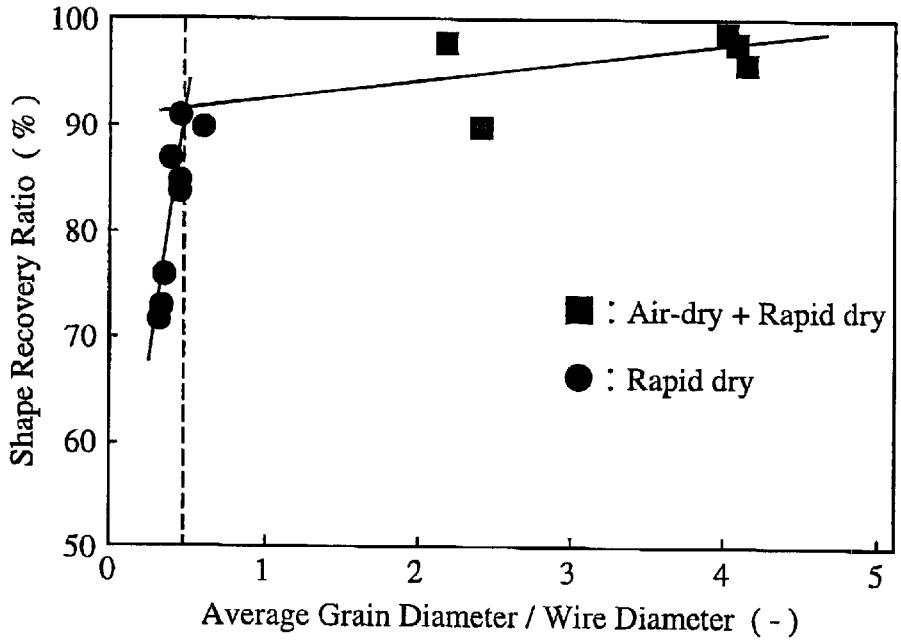
FIG. 12(*a*) is a graph showing a relation between a ratio of average grain diameter in β-phase/wire diameter in a range of 0 to 5 and a shape recovery ratio according to a copper-based alloy wire of Example 12.
Figure 12B:
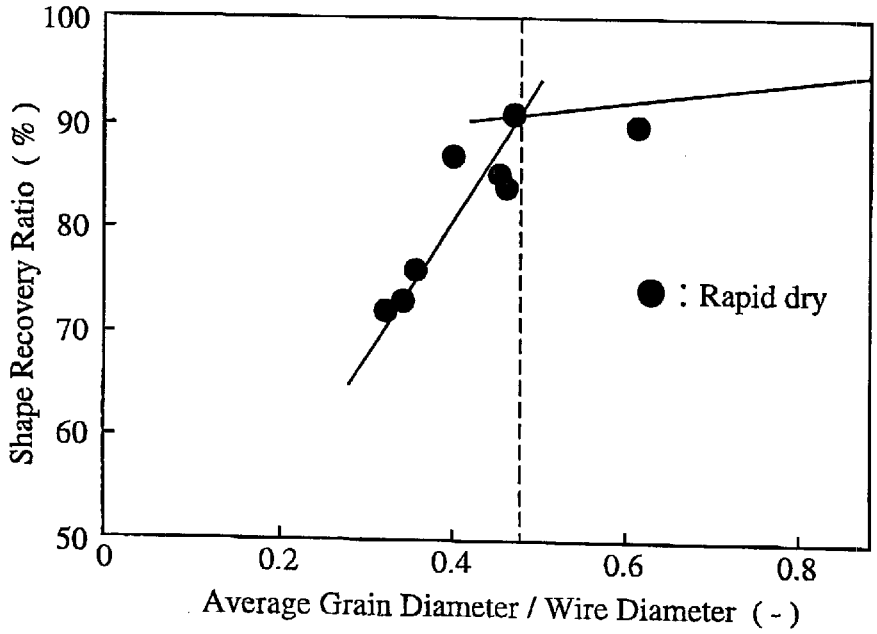

As shown in FIGS. 12(*a*) and (*b*), the shape recovery ratio was increased as the ratio of average grain diameter/wire diameter become larger, and was 90% or more when the average grain diameter is equal to or more than the wire radius.

EXAMPLE 13

Copper-based alloys each having a composition shown in Table 7 were melted, and solidified at a cooling rate of 140° C./minute on average to form billets each having a diameter of 20 mm. Each billet was formed by hot-drawing at 850° C. in a plate shape having a thickness of 2.5 mm. To each drawn alloy was repeated a cycle of annealing at 600° C. for 10 minutes followed by air-cooling and a plurality of cold-rollings three times to produce a plate having a length of 100 mm, a width of 10 mm and a thickness of 0.2 mm. The maximum cold-working ratio in the cold-rolling was 50%, and α-phase volume ratios were each 50 to 70% at the final cold-working. To each of the resultant plates was repeated a cycle of a solution treatment at 900° C. for 10 minutes and air-cooling a plurality of times. Then, the solution-treated plates were rapidly cooled by immersion in water with ice, and subjected to an aging treatment at 200° C. for 15 minutes, to obtain various copper-based alloy plates.

TABLE 7

| Sample No. | Composition of copper-based alloy (weight %) | | | | | | | | | |
|---|---|---|---|---|---|---|---|---|---|---|
| | Cu | Al | Mn | Fe | Co | Ni | Ti | B | C | Cr |
| 1 | 82.2 | 8.1 | 9.7 | — | — | — | — | — | — | — |
| 2 | 81.1 | 8.2 | 9.7 | 1 | — | — | — | — | — | — |
| 3 | 81.2 | 8.1 | 10.2 | — | 0.5 | — | — | — | — | — |
| 4 | 81.5 | 8.1 | 9.8 | — | 0.5 | — | 0.09 | 0.04 | — | — |
| 5 | 81.6 | 8.1 | 9.8 | — | 0.5 | — | — | 0.04 | — | — |
| 6 | 80.4 | 8.0 | 9.5 | — | — | 2.1 | — | — | — | — |
| 7 | 80.4 | 8.2 | 9.8 | — | — | 2.1 | — | 0.04 | — | — |
| 8 | 80.5 | 8.2 | 9.8 | — | — | 2.1 | — | — | 0.04 | — |
| 9 | 79 | 7.8 | 9.3 | — | — | 2.1 | — | — | — | 1.8 |

Figure 13A:
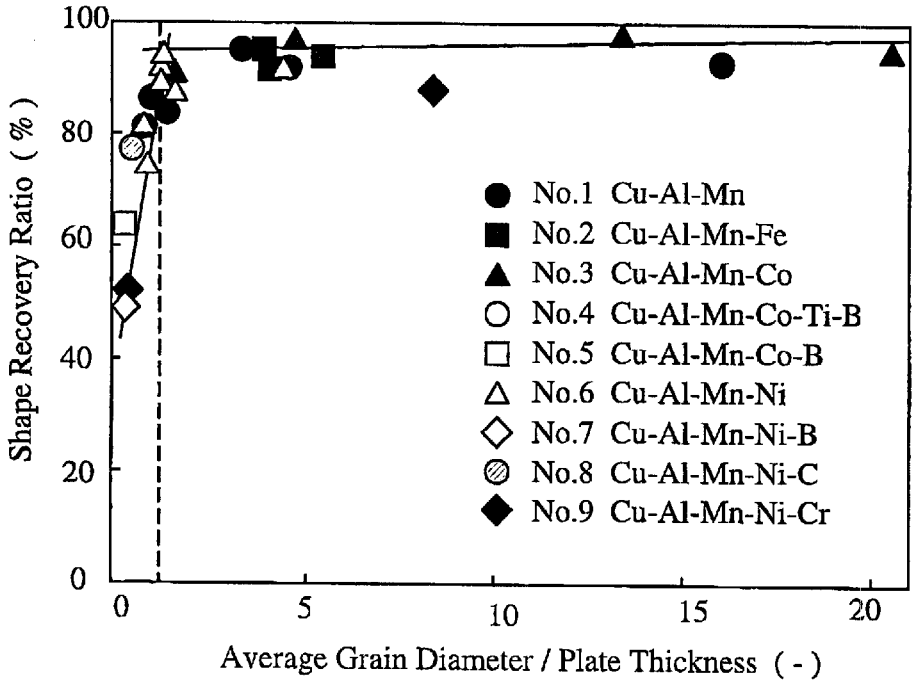
FIG. 13(*a*) is a graph showing a relation between a ratio of average grain diameter in β-phase/plate thickness in a range of 0 to 20 and a shape recovery ratio according to copper-based alloy plates of Example 13 each having different composition.
Figure 13B:
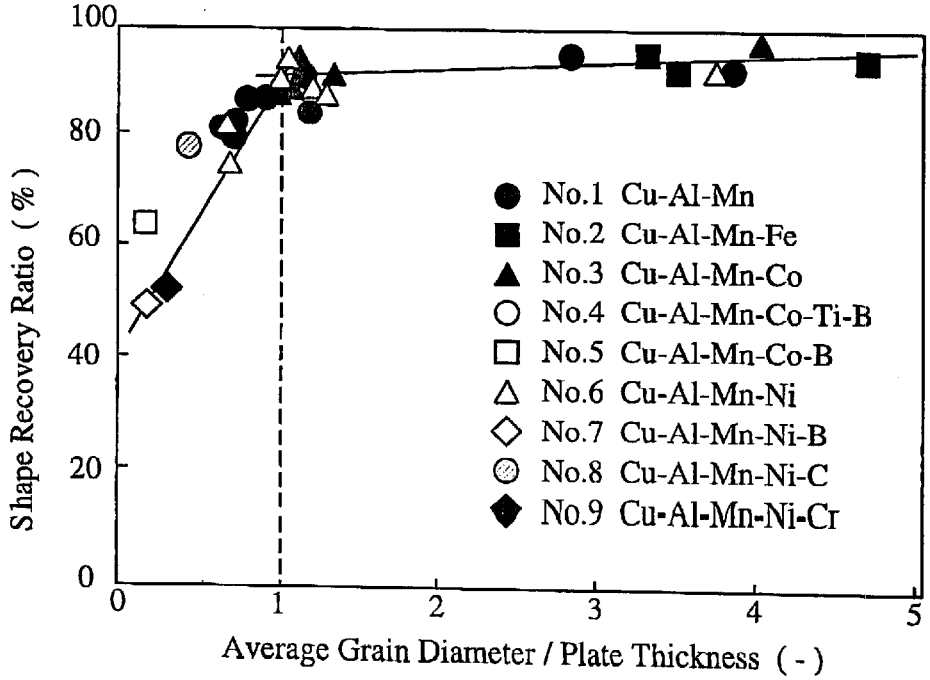

Each of the obtained plates was applied 6% of strain to, and the shape recovery ratio of each plate was obtained in the same manner as Example 1. The results are shown in FIGS. 13(*a*) and (*b*). As shown in FIG. 13, the shape recovery ratio was extremely improved as the average grain diameter become nearer the plate thickness, and was 90% or more when the average grain diameter $d_{av}$ was equal to or more than the plate thickness. The results show that the shape memory properties of the copper-based alloy also remarkably depend on the average grain diameter in the β-single phase.

As described in detail above, a copper-based alloy according to the present invention has a recrystallization structure substantially composed of β-angle phase having crystal orientation aligned in a working direction, to exhibit more excellent shape memory properties and superelasticity than those of conventional copper-based alloys. The copper-based alloy of the present invention is excellent in workability, thereby being inexpensively formed in various members such as a wire, plate, foil, spring, pipe, etc. In particular, the shape memory properties and superelasticity are extremely improved when an average grain diameter of the β-single phase is equal to or more than the plate thickness or the wire radius.

What is claimed is:

1. A copper-based alloy having shape memory properties and superelasticity, wherein said copper-based alloy has a recrystallization structure substantially composed of β-single phase having crystal orientation aligned in a cold-working direction, and wherein the crystal orientation density measured by an electron back scattering pattern method is 2.0 or more in said cold-working direction.

2. The copper-based alloy according to claim 1, wherein said crystal orientation of said β-single phase is <110> or <100> orientation.

3. The copper-based alloy according to claim 1 having a composition comprising 3 to 10 weight % of Al, 5 to 20 weight % of Mn, the balance being substantially Cu and inevitable impurities.

4. The copper-based alloy to claim 3, wherein said composition further comprises at least one element selected from the group consisting of Ni, Co, Fe, Ti, V, Cr, Si, Nb, Mo, W, Sn, Sb, Mg, P, Be, Zr, Zn, B, C, Ag and misch metals in a total amount of 0.001 to 10 weight % based on said copper-based alloy of 100 weight %.

5. A wire made of the copper-based alloy according to claim 1, wherein said copper-based alloy has an average grain diameter equal to or more than the radius of said wire.

6. By The wire according to claim 5, wherein a region of said wire, in which said copper-based alloy has a grain diameter equal to or more than said radius, has a length of 30% or more based on the entire length of said wire.

7. A guide wire for a catheter composed of the wire according to claim 5.

8. A twisted wire composed of the wire according to claim 5.

9. An antenna composed of the twisted wire according to claim 8.

10. An antenna composed of the wire according to claim 5.

11. A plate or a foil made of the copper-based alloy according to claim 1, wherein said copper-based alloy has an average grain diameter equal to or more than a thickness of said plate or foil.

12. The plate or foil according to claim 11, wherein a region of said plate or foil, in which said copper-based alloy has a grain diameter equal to or more than said thickness, has an area of 30% or more based on the entire area of said plate or foil.

13. A connector member composed of the plate or foil according to claim 11.

14. A clip for writing implements composed of the plate according to claim 11.

15. A pipe made of the copper-based alloy according to claim 1, wherein said copper-based alloy has an average grain diameter equal to or more than a thickness of said pipe.

16. The pipe according to claim 15, wherein a region of said pipe, in which said copper-based alloy has a grain diameter equal to or more than said thickness, has an area of 30% or more based on the entire area of said pipe.

17. A catheter composed of the pipe according to claim 15.

* * * * *